United States Patent [19]

Blair

[11] 4,026,190

[45] May 31, 1977

[54] MORTAR SIGHTING DEVICE

[76] Inventor: Oather Blair, 8415 Lou Court, Louisville, Ky. 40219

[22] Filed: Sept. 22, 1975

[21] Appl. No.: 615,289

[52] U.S. Cl. ..... 89/41 B; 89/37 C; 89/41 L; 33/235; 33/241

[51] Int. Cl.[2] ..... F41G 1/34

[58] Field of Search ..... 89/37 C, 41 B, 41 E, 89/41 L, 40 A, 40 J, 1 E, 1 J; 33/235, 241; 356/138, 154

[56] References Cited

UNITED STATES PATENTS

| | | | |
|---|---|---|---|
| 2,444,334 | 6/1948 | Caulkins | 89/37 C |
| 2,558,024 | 6/1951 | Weiss et al. | 89/37 C |
| 2,977,858 | 4/1961 | Jasse | 89/37 C X |
| 3,891,323 | 6/1975 | Ryan et al. | 356/154 |

FOREIGN PATENTS OR APPLICATIONS

| | | | |
|---|---|---|---|
| 8,154 | 11/1900 | United Kingdom | 89/40 J |

*Primary Examiner*—David H. Brown
*Attorney, Agent, or Firm*—Edward M. Steutermann

[57] ABSTRACT

The present invention provides an arrangement useful in sighting a missile firing weapon, such as a mortar, from a fixed emplacement or from a platform on a weapon carrying vehicle which can include a ring, marked with selected angular indications such as azimuth or mil readings (6400 mils equals 360°), where the weapon is mounted in the center of the ring. The weapon is provided with a sighting mechanism to aim the weapon in accordance with sightings indicated on the ring.

In addition, a light source can be provided which is particularly useful to aim the weapon at night. The light source includes a tubular member having at least two transverse walls spaced generally parallel therein where a slit is provided in each wall with slits located in longitudinally aligned relation and a light source is provided to direct a beam of light through the cooperative slits to the aiming means. The light source can further be adapted to be attached to selected positions on the ring means at selected azimuth readings to align the weapon and to receive a compass for selectively directing the beam.

4 Claims, 4 Drawing Figures

MORTAR SIGHTING DEVICE

BACKGROUND OF THE INVENTION

Prior sighting devices have been provided for use in connection with aiming missile firing weapons for example, mortars. In the case of mortars to be fired in daylight, the mortar is usually established in an initial direction toward a target along a line termed an observation or datum direction, determined, for example, by means of two suitably spaced aiming posts located downrange of the mortar toward a selected target. The aiming posts are placed by dispatching personnel downrange from the mortar and locating the posts by audible or arm and hand signals given by personnel located at the weapon. The exposure to enemy fire, and resultant danger, to such personnel, particularly the downrange personnel is great. In order to aim the mortar, the aiming sight of the mortar is turned so that the plane of the axis of the aiming sight is in alignment with the aiming posts determining the observation direction and reference line. Usually two aiming posts are provided to establish a reference line, including a far aiming post usually being placed about 100 meters from the mortar and a nearer post placed about halfway between the far aiming post and the mortar itself. The reference line then provides a base reference for use in sighting the mortar to other nearby selected targets. When it is required to effect a fire switch through a given angle, that is to change the direction of fire for example through a certain angle toward the right, the sight is rotated through the same angle toward the left and thereafter the mortar barrel is pivoted toward the right until the center of the cross hairs of the sight is once more on the aiming post.

In some cases, it is necessary to fire from a defiladed position, (cave, shell-hole, etc) which does not permit aiming marks, for example aiming posts to be placed at sufficient distances to suitably reduce the aiming error in azimuth. In such cases the accuracy of fire is adversly affected.

It is also necessary to fire such weapons at night and in prior practice, aiming posts with light sources have been placed at selected locations downrange of the mortar where the sighting device is referenced on the light sources. Such arrangements have been generally unsatisfactory in that the aiming posts are easily sighted by the enemy and can be used to indicate the position of the mortar.

SUMMARY OF THE INVENTION

The arrangement provided by the present invention includes a ring where a missile firing weapon, for example a mortar, is located in the center of the ring. The ring is marked with azimuth readings to be used in aiming the weapon. The weapon is provided with a sighting or aiming device to locate a reference line and align the weapon. Where the mortar is to be moved through a selected angle of deflection, the new angle is marked on the ring and the weapon sight is then aligned with the new mark.

With the scope of the present invention, a light source can be provided to aim the weapon at night where the light source includes a tubular member having spaced, generally parallel, transverse walls therein. Each wall has an elongate generally vertical slit therein where the slits are in longitudinally aligned relation so light from the light source is directed through the cooperative slits to a selected location on the ring or the sight of the aiming device.

The ring arrangement can likewise be permanently mounted on a vehicle platform where means are provided to mount a mortar within the ring and the mortar or other weapon is likewise mounted for independent rotation within the ring for readily aiming the weapon.

The new, novel, and useful method and apparatus provided by the present invention eliminates the use of aiming posts and instrument lights as previously discussed so the element of surprise fire is greatly increased the accuracy of the weapon is increased markedly and the exposure of personnel to enemy fire is significantly reduced. The arrangement further provides means for eliminating all errant light sources ordinarily encountered in connection with night firing of a mortar as well as the need for audible voice commands and arm and hand signals. Further, the arrangement provided by the present invention can be adapted for use in connection with mortars mounted on vehicles or individual troop carrying mortars which can be moved to new areas under cover of darkness and new targets engaged. Furthermore the arrangement provided by the present invention allows the weapon to engage separate targets in a matter of seconds. Various other features of the present invention will become obvious to those skilled in the art upon reading the disclosure set forth hereinafter.

BRIEF DESCRIPTION OF THE DRAWINGS

Referring now to the drawings which illustrate one example of an arrangement in accordance with the present invention:

Referring to FIG. 1 a mortar is shown including a mortar mount assembly 1, to support mortar barrel 2 which is pivotably mounted in a base plate 3 by means of a ball 4 carried by mortar barrel 2. A sight assembly 6 is carried on barrel 2, as is commonly known, and provides means for aiming the mortar barrel with respect to both deflection and elevation as hereinafter described.

Figure 1:
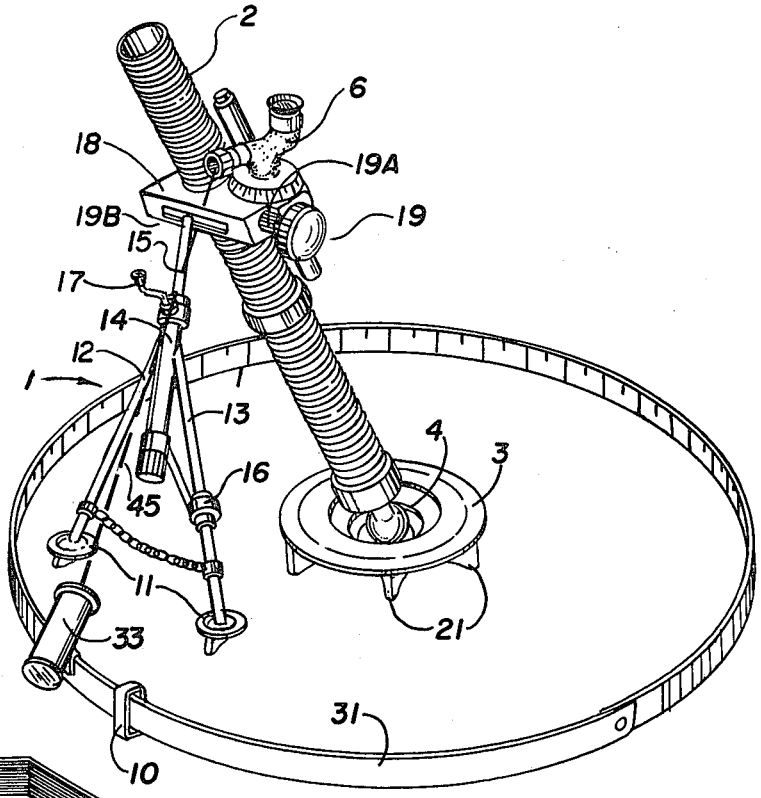
FIG. 1 is a perspective view of a mortar illustrating an arrangement in accordance with the present invention.

Mortar mount assembly 1 provides feet 11 to be positioned in the ground, where one foot 11 is carried by a fixed leg 12 and another foot 11 is carried by a telescopically adjustable leg 13, where the mortar is leveled by adjustment of leg 13. Mount assembly 1 further includes an elevating housing 14, provided with an extensible arm 15 for selectively adjusting the elevation of the mortar barrel where housing 14 is connected to leg 13 by means of a connecting rod 16. An elevating crank 17 is provided to extend and retract arm 15 for adjusting the elevation of mortar barrel 2 which is received in a cooperative yoke 18 of mount assembly 1.

A traversing handwheel 19 is provided for adjusting the deflection of mortar barrel 2, all as known in the art, where a threaded shaft 19A is provided for lateral deflection of barrel 2. Base plate 3 which is provided to receive ball 4 of barrel 2 is provided with feet 21 to secure the position of the mortar and includes a socket, (not shown), to receive ball 4 of barrel 2.

Sight assembly 6 can include a telescope sight with a cross hair aiming reticle and a spirit level for leveling the mortar barrel. The cross hair reticle can be illuminated for night operation. The reticle pattern (not shown) can include two lines at right angles to each other where both center lines can be granted every mil from five to eightly five for adjustment of the line of fire of the barrel. The sight unit is used to align the mortar barrel with respect to select reference points.

Figure 3:
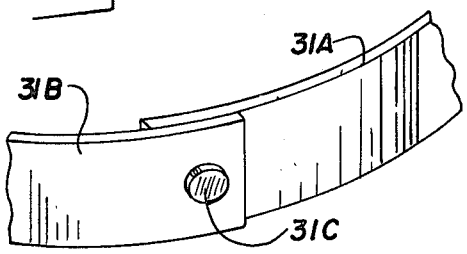
FIG. 3 is a sectional view of a portion of an aiming ring which can be provided in accordance with one feature of the present invention.

In previous mortar fire procedures, sighting stakes are located downrange of the mortar to be used to align the barrel of the mortar. The present invention, however, provides means to align the mortar barrel by alignment of selected positions on a sighting ring 31 which is provided to surround a portion of the mortar emplacement, with the base plate 3 located in the center of the ring. Ring 31 can be adapted to include several pivotable sections 31A, 31B as shown in FIG. 3 where a latch connection (not shown) can be provided so that ring 31, when unlatched, can be folded into a compact package for moving. Ring 31 can be graduated around the circumference to indicate azimuth readings and/or mil readings for alignment and adjustment of the mortar barrel as hereinafter described.

In other arrangements, a boresight can be used in place of sight 6 equally well with the arrangement provided by the present invention.

Sighting assembly 6, in any event, is of any conventional type to facilitate aiming the mortar in accordance with selected azimuth positions. The mortar can be adjusted by means of handwheel 19 and screw assembly 19A within limits to selected azimuth readings without the necessity of moving mount assembly 1.

In previous arrangements, as previously described, the mortar was aligned by sighting on aiming posts located downrange from the mortar toward a selected target, then measuring an angle of deflection therefrom to correct fire or to change targets from the same location.

In accordance with another feature of the present invention, a novel light beam apparatus is provided to facilitate night firing of weapons such as mortars. In the example shown in FIG. 2, a light source arrangement 35 is provided including a tube 33 with a plate 34 provided with a generally vertical slit 34A at one end of the tube and a second plate 36 is located in spaced parallel relation from plate 34 along the tube where plate 36 has a generally vertical slit 36A disposed so slits 34A and 36A are in general longitudinal alignment within the tube 33. A light source, for example, a battery powered lightbulb 39 is provided in a chamber 41 defined between plate 36 and endwall 27 of tube 33 at the end of tube 33, as shown, to provide a light beam to pass through slits 34A and 36A.

Figure 2:
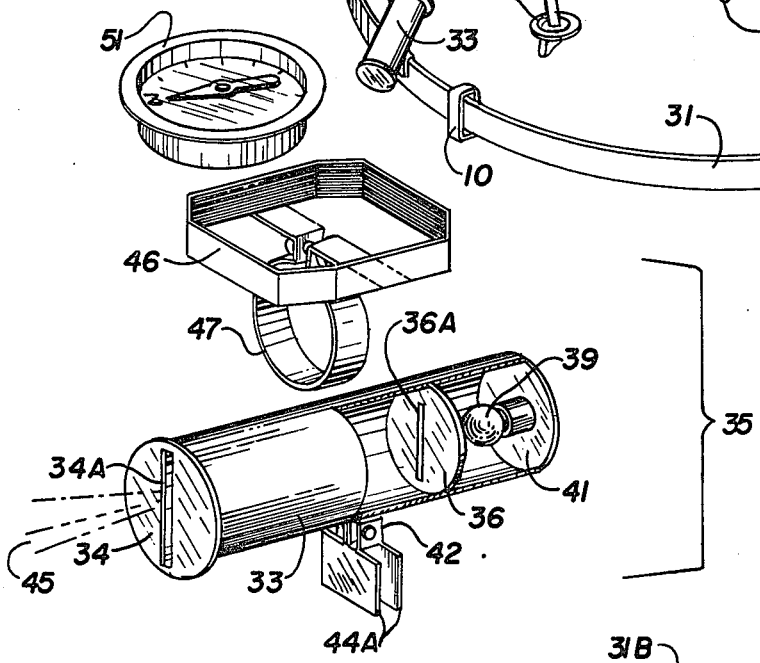
FIG. 2 is a view, partially in section, of a light source which can be provided in accordance with one feature of the present invention.

As shown in FIG. 2, a compass holder 46 is provided and includes a ring 47 adapted to receive tube 33. A compass, can be provided to be received by holder 46 to facilitate aiming the mortar as hereinafter described. The compass is received by holder 46 and can advantageously, include alignment means to sight the compass so that the beam of light emitted from slit 34A is directed in the direction in which the compass is sighted.

A clip member 42, including spaced generallly parallel plates 44A can be provided to secure the light arrangement at a selected location on ring 31 as illustrated generally in FIG. 1, so that a light beam is directed from light through slits 34A and 36A to provide a very narrow slit of light 45 emitted from slit 34A to be received by the reticle of sight 6.

Ring 31 can be continuous or can be made up of separate sections, for example as shown in FIG. 3, section 31A and 31B pivotably connected by pin 31C. A lock (not shown) can be provided at two separate ends of adjacent sections so the ring can be opened and folded to provide a compact arrangement which can be opened to form the ring. A marker ring 10 can be provided to be located to selected positions on the ring as described hereinafter.

Figure 4:
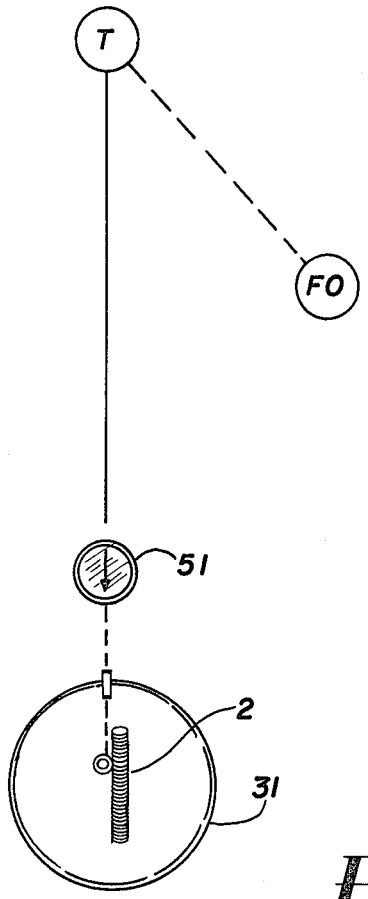
FIG. 4 is a schematic diagram illustrating operation of the example of the method and apparatus in accordance with the present invention shown in the Figures.

With reference to FIG. 4, which is a schematic diagram illustrating one means of utilization of the subject invention, the mortar 2 is placed within ring 31 at a selected location. A target is located by a forward observer F, O who then communicates the azimuth reading from the location of the mortar 2 to the target. Personnel at the mortar location then utilizing a compass in daylight operation, align the reverse reading and note the position of intersection of the line of sight of the compass on ring 31. In daytime firing, ring 10 is then moved to the intersection of the line of sight of the compass and ring 31. Sight 6 of mortar 2 is then aimed by aligning sight 6 with ring 10 on ring 31 and the mortar then can be fired at the proper azimuth reading.

In night firing, the forward observer locates the target, communicates the proper azimuth reading to the gun emplacement. A compass, is placed in holder 46 and, with personnel a few feet from ring 31, and light 39 on, the compass is aligned so that beam of light 45 emitted from slit 34A is directed along the reverse azimuth and indicates a location on ring 31. The light is allowed to remain on and is aimed toward sight 6 of mortar 2. The mortar is then adjusted so that sight 6 is in alignment with light beam 45 emitted from slit 34A of light 35 and the mortar is fired along the proper firing line.

It will be understood that the foregoing is but one example of a method and arrangement in accordance with the present invention and that other arrangements or methods within the scope of the present invention will occur to those skilled in the art.

The invention claimed is:

1. A missile firing weapon emplacement, including a missile firing weapon; ring means, separated from said weapon to be affected by the recoil of said missile firing weapon, and located a selected distance from said missile firing weapon surrounding a portion of the missile firing weapon emplacement wherein said weapon is located generally at the center of said separate ring means;

indicator means to indicate location of selected azimuth readings on said separate ring means; and sighting device means to align said missile firing weapon with said indicator means on said separate ring means.

2. The invention of claim 1 wherein said indicator means includes light beam directing means including a generally tubular casing; light source means disposed to direct a beam of light through said tubular means; light beam defining means to emit a beam of light of selected width from said tubular means and, when said tubular means are cooperatively carried on said separate ring means, toward said sighting device means.

3. The apparatus of claim 2 including compass receiving means to be secured to said tubular means to receive a compass to selectively direct said beam of light emitted from said tubular means toward said sighting device means.

4. A method of aiming a missile firing device (including:) comprised of selecting a target at which said missile firing weapon is to be aimed; locating a missile firing weapon at a selected permanent or temporary location; obtaining azimuth readings from said missile firing weapon to said target; locating the reverse of said azimuth reading on a separate ring surrounding a portion of said missile firing weapon, where said separate ring is unaffected by the recoil of said missile firing weapon; and sighting said weapon with reference to said azimuth location on said separate ring means.

* * * * *